US009817357B2

(12) United States Patent
Kato et al.

(10) Patent No.: US 9,817,357 B2
(45) Date of Patent: Nov. 14, 2017

(54) SHEET PROCESSING APPARATUS, CONTROL METHOD, AND IMAGE FORMING APPARATUS CAPABLE OF FORMING FOLDING STRIPE ON SHEETS

(71) Applicant: CANON KABUSHIKI KAISHA, Tokyo (JP)

(72) Inventors: Hitoshi Kato, Toride (JP); Yasuo Fukatsu, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 140 days.

(21) Appl. No.: 14/803,276

(22) Filed: Jul. 20, 2015

(65) Prior Publication Data

US 2016/0031671 A1 Feb. 4, 2016

(30) Foreign Application Priority Data

Jul. 29, 2014 (JP) ..... 2014-153768

(51) Int. Cl.
*B65H 43/00* (2006.01)
*G03G 15/00* (2006.01)
(Continued)

(52) U.S. Cl.
CPC ..... *G03G 15/6582* (2013.01); *B31F 1/08* (2013.01); *B42C 7/005* (2013.01); *B42C 19/02* (2013.01); *B65H 43/00* (2013.01); *B65H 45/18* (2013.01); *B65H 45/30* (2013.01); *G03G 15/6594* (2013.01); *B65H 2301/4213* (2013.01); *B65H 2301/42146* (2013.01); *B65H 2301/4505* (2013.01); *B65H 2301/5126* (2013.01); *B65H 2408/12* (2013.01); *B65H 2511/13* (2013.01); *B65H 2511/30* (2013.01); *B65H 2515/112* (2013.01); *B65H 2801/27* (2013.01); *G03G 2215/00738* (2013.01); *G03G 2215/00877* (2013.01)

(58) Field of Classification Search
CPC .. G03G 15/6582; G03G 15/6594; B31F 1/08; B42C 19/02; B65H 43/00; B65H 45/18; B65H 45/30
USPC ..... 270/32
See application file for complete search history.

(56) References Cited

U.S. PATENT DOCUMENTS 8,083,661 B2 * 12/2011 Garner ..... B31F 1/10 493/355
8,317,179 B2 * 11/2012 Takata ..... B26F 1/02 270/30.08

(Continued)

FOREIGN PATENT DOCUMENTS

JP 2000-272823 A 10/2000

*Primary Examiner* — Patrick Mackey
(74) *Attorney, Agent, or Firm* — Fitzpatrick, Cella, Harper & Scinto

(57) ABSTRACT

A sheet processing apparatus that can suppress a reduction in a quality of a finish of a fold part of a stack of center-folded sheets without losing an ease of center-folding. The sheet processing apparatus comprises a creasing unit for forming a folding stripe on a sheet so as to facilitate folding the sheet, and an acquisition unit for acquiring information related to a thickness of the sheet. One or more sheets to be provided with folding stripes are determined, from among a plurality of sheets to be folded, according to the information related to the thickness of the sheets, and each of the determined one or more sheets are provided with a folding stripe.

16 Claims, 11 Drawing Sheets

(51) Int. Cl.

| | |
|---|---|
| ***B31F 1/08*** | (2006.01) |
| ***B65H 45/18*** | (2006.01) |
| ***B65H 45/30*** | (2006.01) |
| ***B42C 19/02*** | (2006.01) |
| ***B42C 7/00*** | (2006.01) |

(56) References Cited

U.S. PATENT DOCUMENTS

| | | | | |
|---|---|---|---|---|
| 8,544,834 | B2 | 10/2013 | Sato et al. | |
| 8,831,503 | B2 * | 9/2014 | Hoover | B31F 1/08 399/407 |
| 9,096,407 | B2 * | 8/2015 | Gamo | B31F 1/07 |
| 2012/0115702 | A1 * | 5/2012 | Ishikawa | B31F 1/08 493/405 |
| 2012/0147388 | A1 * | 6/2012 | Kojima | B65H 5/062 358/1.1 |
| 2012/0157285 | A1 * | 6/2012 | Aiba | B31F 1/08 493/405 |
| 2014/0357463 | A1 * | 12/2014 | Kojima | B65H 45/30 493/442 |
| 2015/0360461 | A1 * | 12/2015 | Sakata | B26F 1/00 101/27 |
| 2016/0090265 | A1 * | 3/2016 | Tsutsumi | B65H 37/06 428/174 |

* cited by examiner

*FIG. 9*

| NUMBER OF SHEETS | GRAMMAGE W (gsm) | | |
|---|---|---|---|
| | W≦80 | 80<W≦150 | 150<W |
| 1ST | NO | NO | NO |
| 2ND | NO | YES | YES |
| 3RD | NO | NO | NO |
| 4TH | YES | NO | YES |
| 5TH | NO | YES | NO |
| 6TH | NO | NO | YES |
| 7TH | NO | NO | NO |
| 8TH | YES | YES | YES |
| 9TH | NO | NO | NO |
| 10TH | NO | NO | YES |
| 11TH | NO | YES | NO |
| 12TH | YES | NO | YES |
| 13TH | NO | NO | NO |
| 14TH | NO | YES | YES |
| 15TH | NO | NO | NO |
| 16TH | YES | NO | YES |
| 17TH | NO | YES | NO |
| 18TH | NO | NO | YES |
| 19TH | NO | NO | NO |
| 20TH (COVER SHEET) | YES | YES | YES |

SHEET PROCESSING APPARATUS, CONTROL METHOD, AND IMAGE FORMING APPARATUS CAPABLE OF FORMING FOLDING STRIPE ON SHEETS

BACKGROUND OF THE INVENTION

Field of the Invention

The present invention relates to a sheet processing apparatus, a control method thereof, and an image forming apparatus having the sheet processing apparatus, and more particularly, relates to a sheet processing apparatus that performs saddle stitch bookbinding, and a control method thereof, and an image forming apparatus having the sheet processing apparatus.

Description of the Related Art

A sheet processing apparatus that performs saddle stitch bookbinding, generally overlays a plurality of sheets and folds the sheets in the center (center-folding) at a time to bookbind. In an example of the sheet processing apparatus that performs saddle stitch bookbinding, stripes are formed on the sheets in advance, before the center-folding is performed on the sheets, at parts to be creases formed during the center-folding, and the sheets with the stripes formed thereon are center-folded with the sheets overlaid (for example, see Japanese Laid-Open Patent Publication (Kokai) No. 2000-272823). The stripes for the center-folding, which are formed on the sheets, make it possible to easily perform the center-folding on not only regular paper, but also thick paper. The stripes further prevent peeling of a toner image printed on a sheet supposed to be a cover sheet at the bookbinding.

However, the formed stripes produce rising parts on the sheets. Therefore, when a plurality of sheets are center-folded and overlaid, if the stripe-formed positions of the sheets vary, the overlaying of the sheets with the stripes formed thereon may cause gaps between the overlaid sheets. Particularly, if the stripes are formed on all the sheets, the gaps between the overlaid sheets are accumulated at the part to be folded of the sheet bundle, which makes the fold part thick. This may reduce the quality of the finish of the saddle stitch bookbinding.

SUMMARY OF THE INVENTION

The present invention provides a sheet processing apparatus that can suppress the reduction in the quality of the finish of the fold part of a stack of center-folded sheets without losing the ease of center-folding, a control method thereof, and an image forming apparatus having the sheet processing apparatus.

In an aspect of the invention, there is provided a sheet processing apparatus comprising a stripe forming unit configured to form a folding stripe on a sheet so as to facilitate folding the sheet, an acquisition unit configured to acquire information related to thickness of the sheet, and a control unit configured to determine one or more sheets to be provided with folding stripes by the stripe forming unit from among a plurality of sheets to be folded and overlaid, according to the information related to the thickness of the sheets acquired by the acquisition unit and to control the stripe forming unit so as to form the folding stripe on each of the determined one or more sheets.

According to the present invention, the sheets to be provided with the folding stripes are determined, from among the plurality of sheets to be center-folded and overlaid, according to the information related to the thickness of the sheets, and the folding stripes are formed on the determined sheets. This can suppress the reduction in the quality of the finish of the fold part of the stack of folded sheets. When the sheets to be provided with the folding stripes are determined, the number of sheets to be provided with the stripes can be limited without losing the ease of center-folding, which prevents a loss of the ease of folding.

Further features of the present invention will become apparent from the following description of exemplary embodiments with reference to the attached drawings.

BRIEF DESCRIPTION OF THE DRAWINGS

FIG. 9 is a diagram for explaining a sheet determination process performed in the saddle stitch bookbinding process of FIG. 8.

DESCRIPTION OF THE EMBODIMENTS

The present invention will now be described in detail below with reference to the accompanying drawings showing embodiments thereof.

Figure 1:
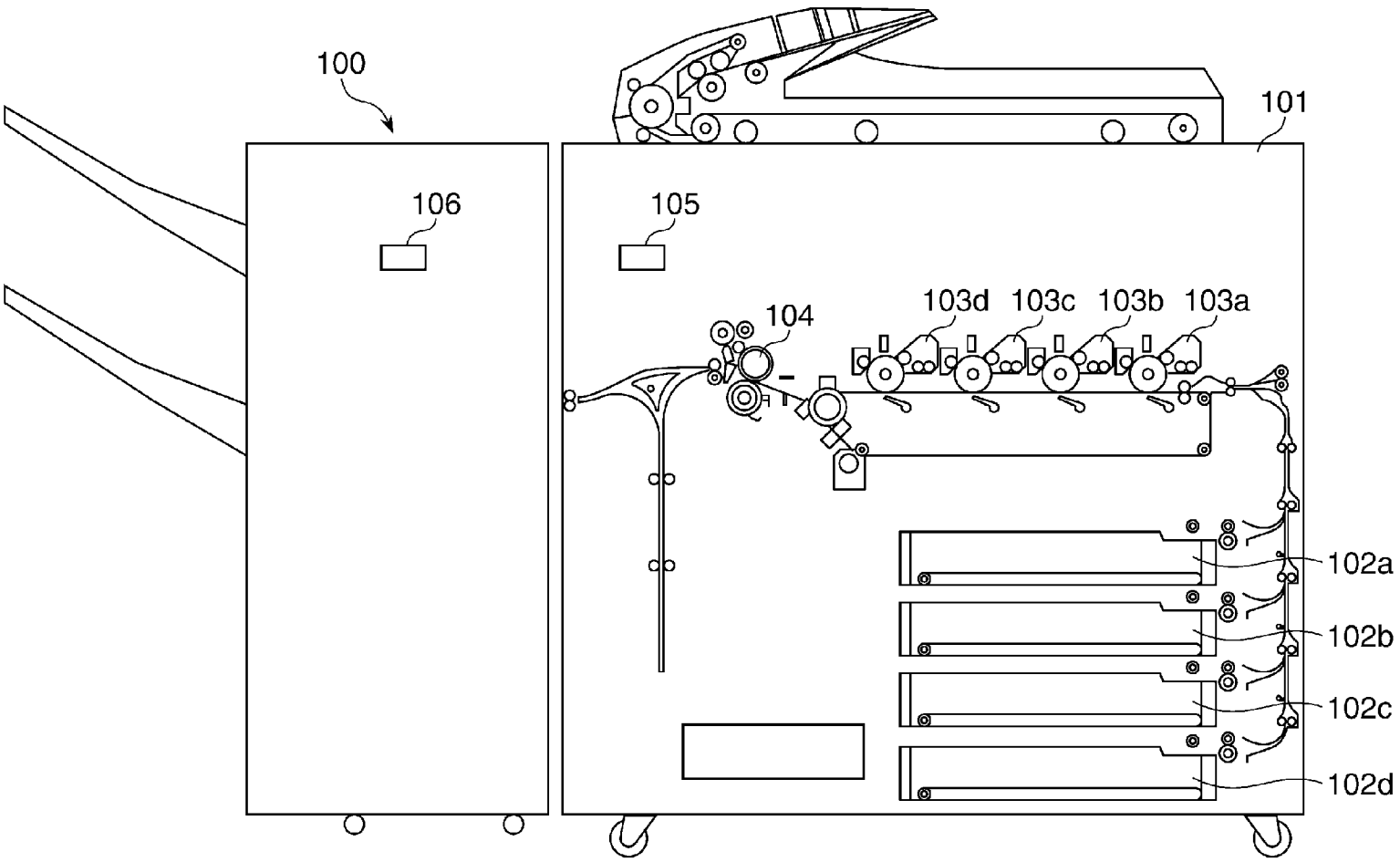
FIG. 1 is a side sectional view schematically showing a configuration of an image forming system having a sheet processing apparatus according to an embodiment of the present invention.

FIG. 1 is a side sectional view schematically showing a configuration of an image forming system having a sheet processing apparatus 100 according to an embodiment of the present invention.

In FIG. 1, the image forming system includes the sheet processing apparatus 100 and an image forming apparatus 101. It should be noted that the sheet processing apparatus 100 and the image forming apparatus 101 may be integrated.

The image forming apparatus 101 includes an image forming control unit 105 having cassettes 102*a* to 102*d*, photosensitive drums 103*a* to 103*d*, a fixing unit 104, and a communication IC (not shown).

The photosensitive drums 103*a* to 103*d*, respectively corresponding to four colors: yellow, magenta, cyan, and black, transfer toner images of the four colors to sheets conveyed from the cassettes 102*a* to 102*d*, and the fixing unit 104 fixes the transferred toner images. The sheets with the fixed toner images thereon are conveyed to the sheet processing apparatus 100. The image forming control unit 105 comprehensively controls the each of the constituent elements included in the image forming apparatus 101. The image forming control unit 105 also communicates with a sheet processing control unit 106, described later, of the sheet processing apparatus 100 through the internal communication IC and transmits, for example, a control signal of the sheet processing control unit 106 and information related to the thickness of a plurality of sheets to be center-folded used in a saddle stitch bookbinding process of FIG. 8 described later.

Figure 2:
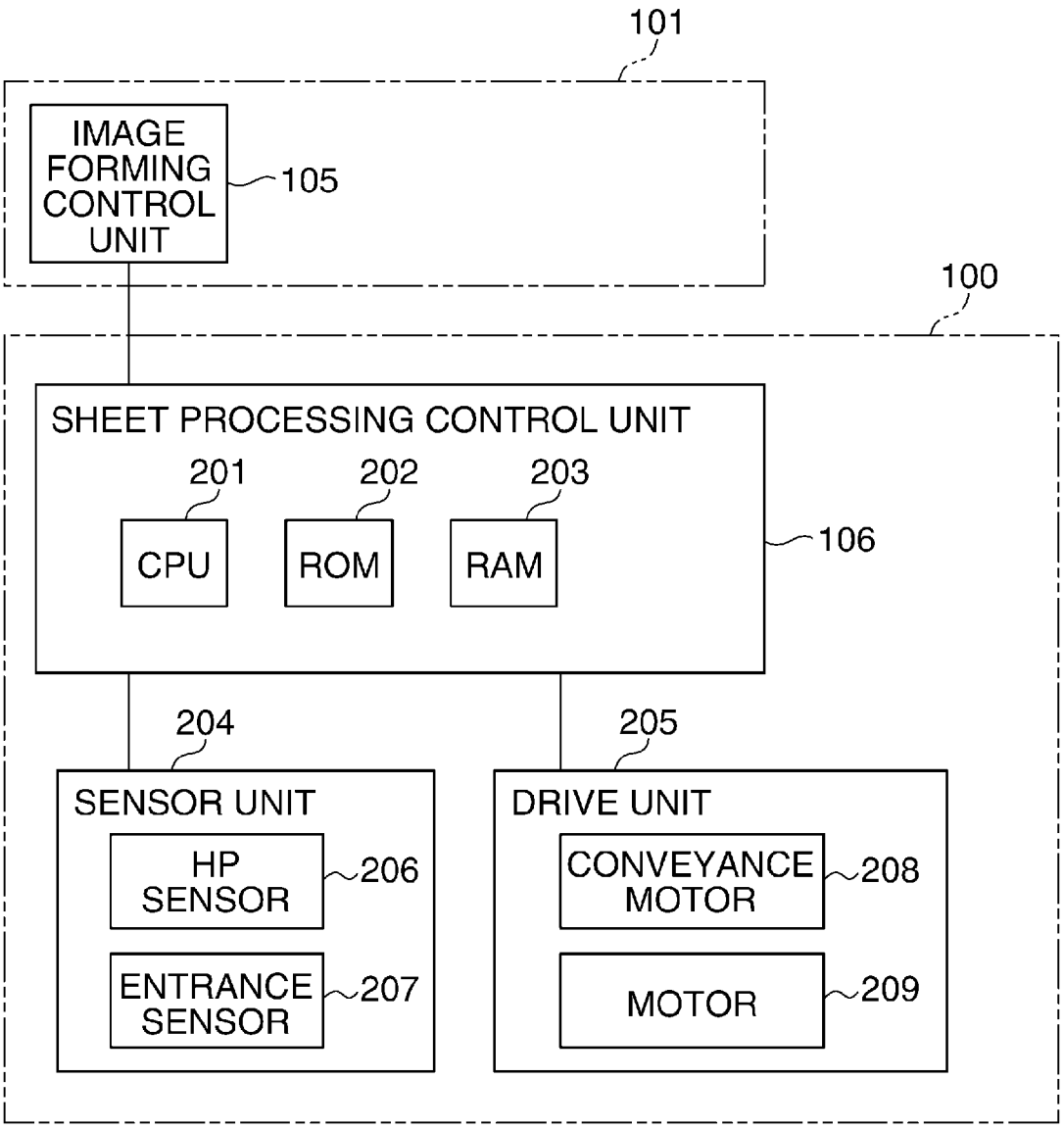
FIG. 2 is a block diagram for explaining a configuration of a sheet processing control unit controlled by the image forming control unit in FIG. 1.

The sheet processing apparatus 100 includes the sheet processing control unit 106, and overlays a plurality of sheets conveyed from the image forming apparatus 101 and perform a stapling process, a saddle stitch bookbinding process, etc. As shown in FIG. 2, the sheet processing apparatus 100 includes, in addition to the sheet processing control unit 106: a sensor unit 204 having various sensors described later such as an HP sensor 206, an entrance sensor 207, etc.; and a drive unit 205 having various motors described later such as a conveyance motor 208, a motor 209, etc.

The sheet processing control unit 106 includes a CPU 201, a ROM 202, and a RAM 203. The CPU 201 controls various operations of the sheet processing apparatus 100 based on control signals transmitted from the image forming control unit 105. The CPU 201 controls various sensors of the sensor unit 204 and various motors of the drive unit 205, based on control programs stored in the ROM 202, so as to control the operation of the sheet processing apparatus 100. For example, the CPU 201 drives the conveyance motor 208, as described later, to convey the sheets to a predetermined position such that folding stripes are formed at center parts of the sheets. The RAM 203 temporarily stores control data and the like used by the CPU 201.

Figure 3:
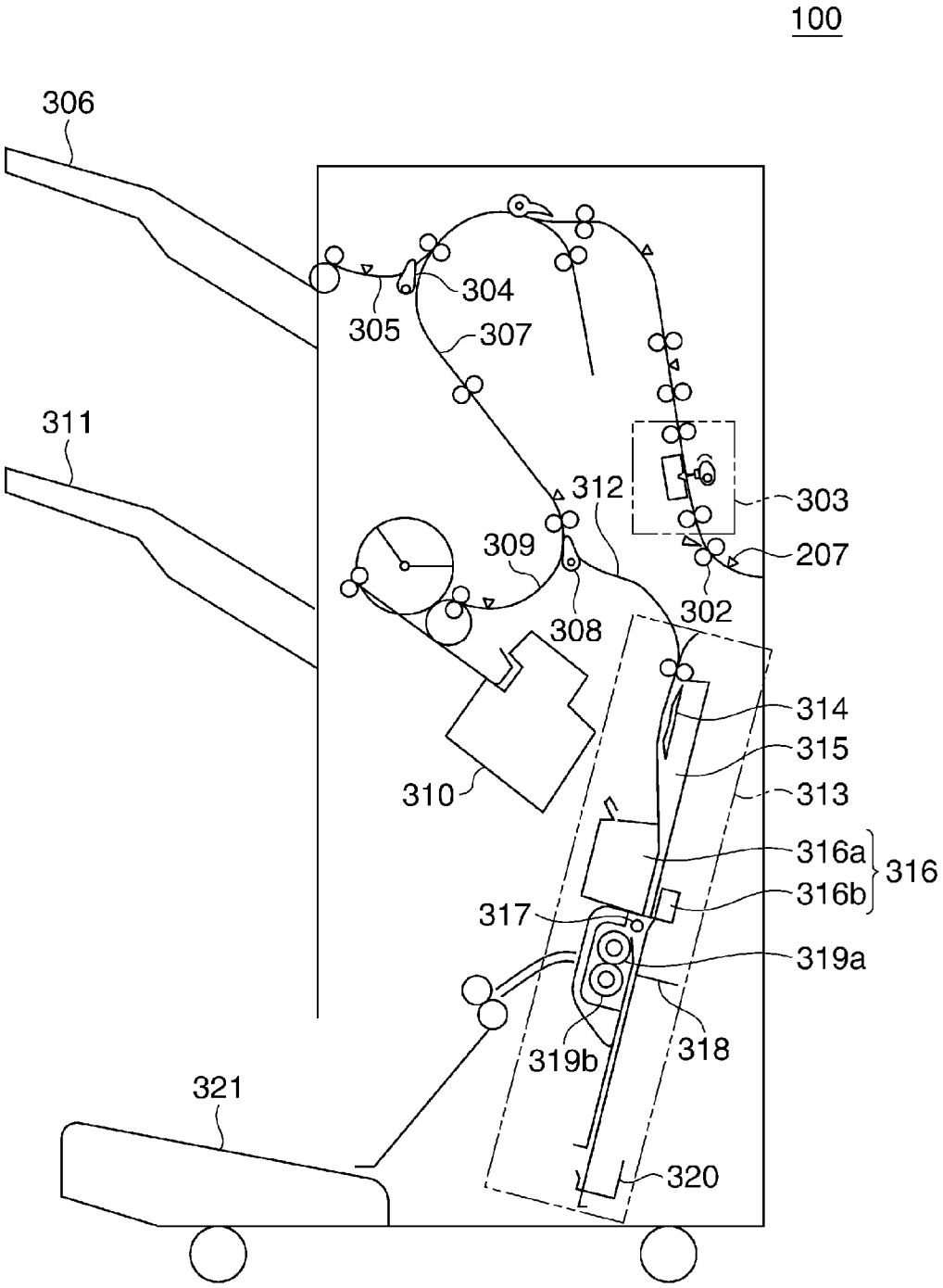
FIG. 3 is a side sectional view schematically showing a configuration of the sheet processing apparatus in FIG. 1.

FIG. 3 is a side sectional view schematically showing a configuration of the sheet processing apparatus 100 in FIG. 1.

In FIG. 3, the sheet processing apparatus 100 includes the entrance sensor 207, a pair of rollers 302, a creasing unit 303, switching flappers 304 and 308, trays 306, 311, and 321, a stapler 310, and a saddle stitch mechanism 313.

The saddle stitch mechanism 313 (bookbinding unit) includes a flapper 314, a storage guide 315, a stapler 316, a slide roller 317, a pushing member 318, a pair of rollers 319*a* and 319*b*, and a sheet positioning member 320.

The stapler 316 includes: a driver 316*a* that pushes out a staple; and an anvil 316*b* that bends the pushed out staple. The driver 316*a* and the anvil 316*b* are provided at opposite positions across the storage guide 315 and perform a stapling process to a plurality of sheets arranged at a stitching position. The pushing member 318 is arranged at a position opposed to the pair of rollers 319*a* and 319*b*, and pushes out a plurality of sheets passing between the pair of rollers 319*a* and 319*b* and the pushing member 318, to push the sheets between the pair of rollers 319*a* and 319*b*.

In the sheet processing apparatus 100, each of the sheets conveyed from the image forming apparatus 101 is sensed by the entrance sensor 207, and each of the sensed sheets is subsequently conveyed to the creasing unit 303 by the pair of rollers 302. The creasing unit 303 forms a strip at each of parts to be creases formed during the center-folding on each of predetermined sheets, as described later.

Each of the sheets conveyed from the creasing unit 303 is conveyed to one of a conveyance path 305 and a conveyance path 307 according to a direction of the switching flapper 304.

Each of the sheets conveyed from the creasing unit 303 is conveyed to the conveyance path 305 and ejected to the tray 306 when, for example, the conveyed sheets are not subjected to the stapling process or the saddle stitch bookbinding. On the other hand, each of the sheets conveyed from the creasing unit 303 is conveyed to the conveyance path 307 when, for example, the conveyed sheets are subjected to the stapling process or the saddle stitch bookbinding.

Then, each of the sheets is conveyed to one of a conveyance path 309 and a conveyance path 312 according to a direction of the switching flapper 308. When the stapling process is performed on the sheets, the sheets are conveyed to the conveyance path 309 due to the switching flapper 308, subjected to the stapling by the stapler 310, and ejected to the tray 311. On the other hand, when the saddle stitch bookbinding process is performed on the sheets, the sheets are conveyed to the conveyance path 312 due to the switching flapper 308, subjected to the saddle stitch booking process by the saddle stitch mechanism 313, and ejected to the tray 321.

Each of the sheets conveyed to the saddle stitch mechanism 313 is carried into the storage guide 315 from an input port (not shown) selected by the flapper 314 according to a size of the sheet. The each of the carried sheets is conveyed by the slide roller 317 until the tips of the sheets touch the movable sheet positioning member 320. Each of the sheets to be subjected to the saddle stitch bookbinding process is conveyed to the sheet positioning member 320, and the plurality of sheets are overlaid.

Here, among the plurality of sheets to be subjected to the saddle stitch bookbinding process, a sheet to be a cover sheet at the completion of the saddle stitch bookbinding process is conveyed at the end. The sheet to be the cover sheet is arranged at a position closest to the pair of rollers 319*a* and 319*b*, i.e. a position farthest from the pushing member 318, among the plurality of sheets to be subjected to the saddle stitch bookbinding process.

When all of the sheets to be subjected to the saddle stitch bookbinding process are conveyed to the sheet positioning member 320, the sheet positioning member 320 descends to adjust the position of the sheets in a conveyance direction.

The sheet positioning member 320 is first adjusted to a position for performing the stapling process to a sheet bundle including a plurality of sheets in the saddle stitch bookbinding process. Specifically, the position of the sheet positioning member 320 is adjusted so that stripes for folding (hereinafter, called the "folding stripes") formed by the creasing unit 303 are arranged at the stitching position of the stapler 316. The position of the sheet positioning member 320 is then adjusted so that the positions of the folding stripes are arranged at a position of the protrusion of the pushing member 318.

In the present embodiment, when the sheet bundle is subjected to only the center-folding without the stapling process in the saddle stitch bookbinding process, the position of the sheet positioning member 320 in the conveyance direction is adjusted so that the positions of the folding stripes of the sheets are arranged at the position of the protrusion of the pushing member 318.

The sheet bundle pushed out toward the pair of rollers 319*a* and 319*b* by the pushing member 318 is caught between the pair of rollers 319*a* and 319*b* and folded by the pressure of the pair of rollers 319*a* and 319*b*. The sheet bundle folded by the pair of rollers 319*a* and 319*b* is ejected to the tray 321.

Figure 4:
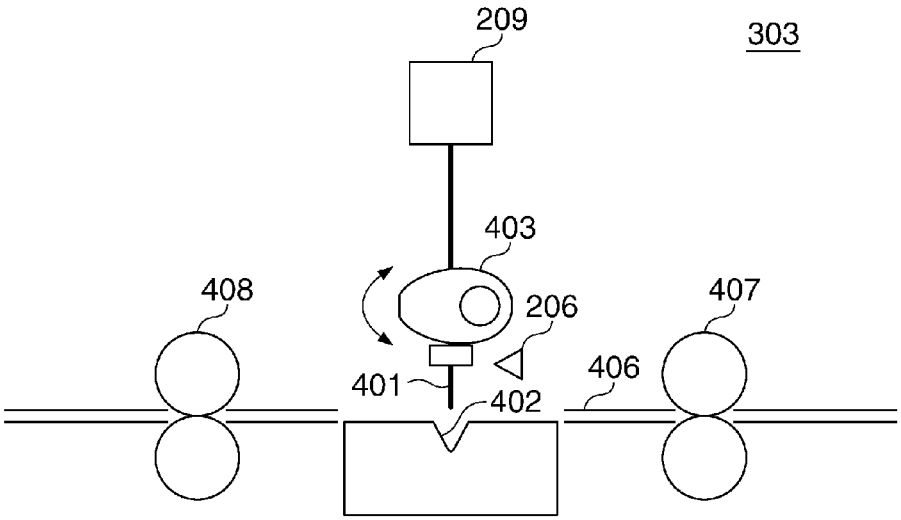
FIG. 4 is a side sectional view schematically showing a configuration of a creasing unit in FIG. 3.

FIG. 4 is a side sectional view schematically showing a configuration of the creasing unit 303 in FIG. 3.

In FIG. 4, the creasing unit 303 includes a creasing member 401, a groove portion 402, a cam portion 403, the motor 209, the HP sensor 206, a conveyance path 406, and pairs of rollers 407 and 408. The creasing member 401 and the groove portion 402 are arranged so as to extend in a direction orthogonal to the conveyance direction of the sheets. The creasing unit 303 forms folding stripes at parts to be crease formed during the center-folding (hereinafter, called the "fold part"), on a predetermined sheet conveyed along the conveyance path 406 in the arrangement direction from the pair of rollers 407 to the pair of rollers 408.

Figure 5:
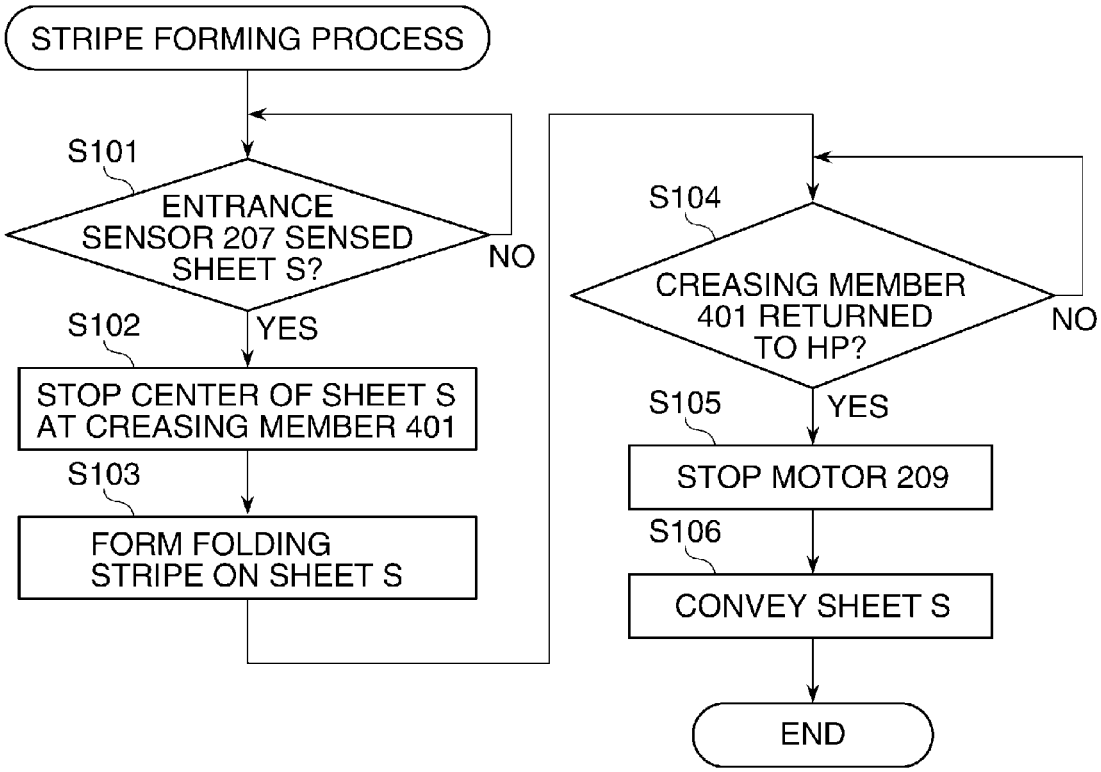
FIG. 5 is a flow chart showing a procedure of a creasing process performed by the creasing unit in FIG. 3.

FIG. 5 is a flow chart showing a procedure of the creasing process performed by the creasing unit 303 in FIG. 3.

The process of FIG. 5 is performed by CPU 201 executing a control program stored in the ROM 202.

Figure 6:
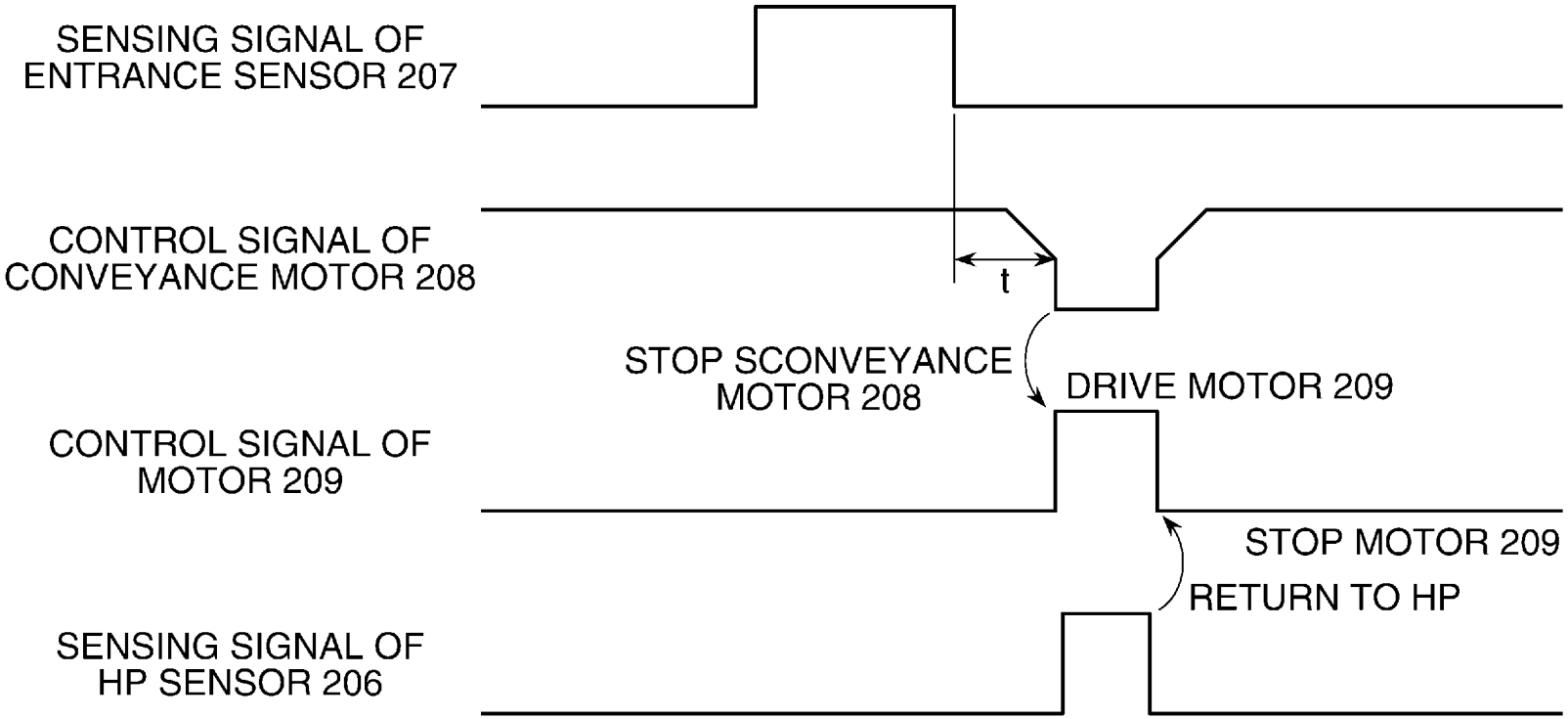
FIG. 6 is a timing chart for explaining operation of the creasing unit in the creasing process of FIG. 5.
Figure 7A:
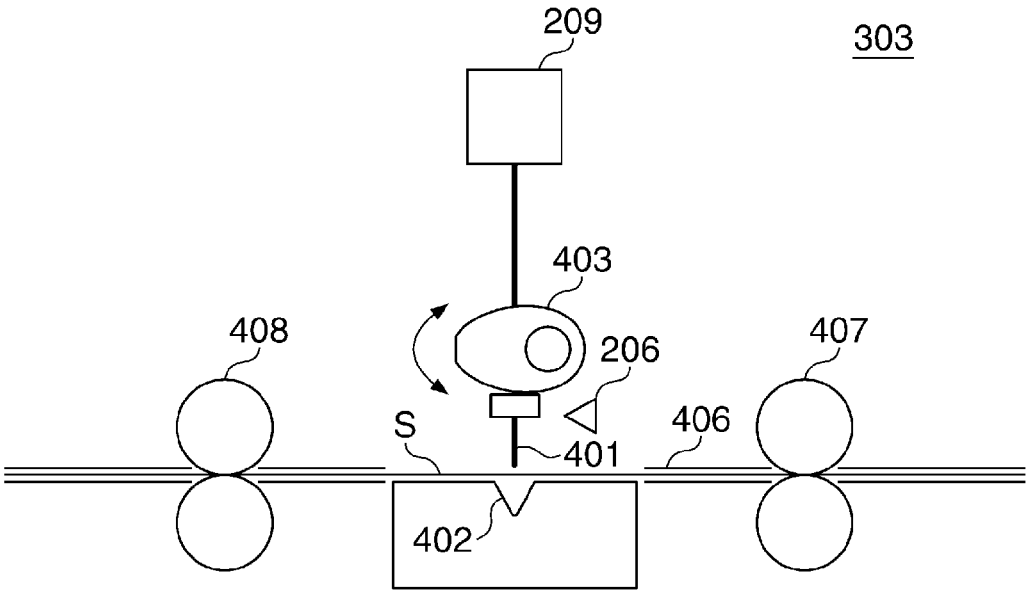
FIGS. 7A and 7B are diagrams for explaining operation of the creasing unit in the creasing process of FIG. 5.

In FIG. 5, first, when the predetermined sheet (sheet S) is sensed by a sensing signal of the entrance sensor 207 shown in FIG. 6 (YES to step S101), the CPU 201 stops, after a lapse of predetermined time "t", the conveyance motor 208 that is configured to drive so as to convey the sheets S according to a control signal of the conveyance motor 208 shown in FIG. 6 (step S102). As a result, the part to be a crease of the sheet S stops at a position facing the creasing member 401 as shown in FIG. 7A. Specifically, the CPU 201 controls the conveyance motor 208 so that the center position of the sheet S in the conveyance direction stops at the position opposing the creasing member 401.

Figure 7B:
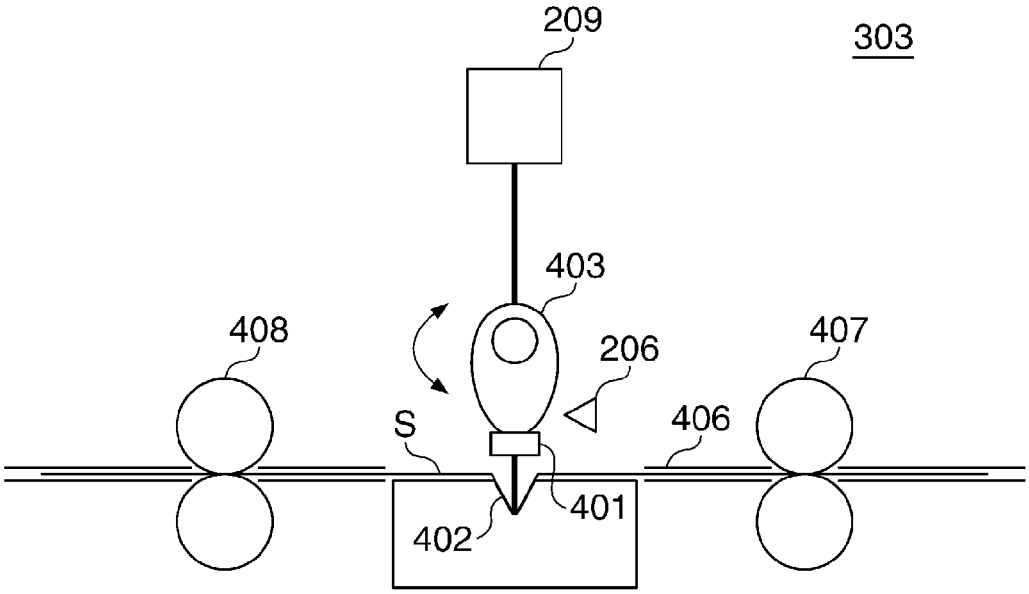

Next, as shown in FIG. 7B, the CPU 201 drives the motor 209 to rotate the cam portion 403 by a control signal of motor 209 shown in FIG. 6 (step S103). As a result, the creasing member 401 moves toward the groove portion 402 to form a folding stripe on the sheet S (step S103).

Next, the CPU 201 drives the motor 209 to reverse the cam portion 403, to thereby move the creasing member 401 to HP (Home Position), which is a standby position. When it is determined, by a sensing signal of HP sensor 206, that the creasing member 401 return to HP (YES to step S104), the CPU 201 stops the motor 209 (step S105). Next, the CPU 201 drives the conveyance motor 208 to convey the sheets S by the pairs of rollers 407 and 408 (step S106), followed by the process terminating.

Figure 8:
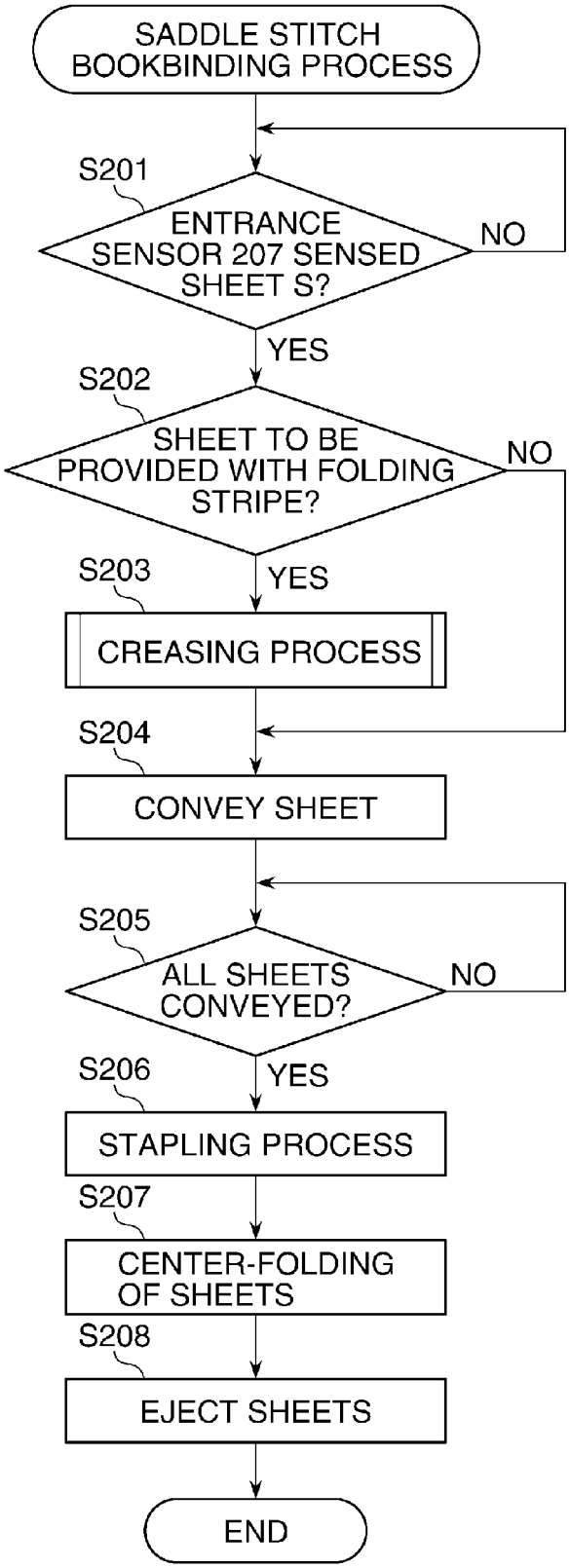
FIG. 8 is a flow chart showing a procedure of a saddle stitch bookbinding process performed by the sheet processing apparatus in FIG. 1.

FIG. 8 is a flow chart showing a procedure of the saddle stitch bookbinding process performed by the sheet processing apparatus 100 in FIG. 1.

The process of FIG. 8 is performed by CPU 201 executing a control program stored in the ROM 202, and the process is performed based on information related to the thickness (grammage) of the plurality of sheets to be center-folded, which is transmitted from the image forming control unit 105. In the process of FIG. 8, all of the plurality of sheets to be center-folded have the same thickness.

When a plurality of sheets provided with folding stripes are center-folded and overlaid, if the respective positions of the folding stripes of the respective sheets, which are conveyed to the sheet positioning member 320 which is configured to adjust the positions of the sheets in the conveyance direction, shift in the conveyance direction, gaps are caused between the overlaid sheets when the sheets with the folding stripes formed thereon are overlaid. Particularly, if all of the sheets have folding stripes formed thereon, the gaps between the sheets are accumulated at the part to be a fold part of the sheet bundle, which makes the fold part thick. This reduces the quality of the finish of the fold part.

In order to address this problem, the process of FIG. 8 determines the number of sheets to be provided with the folding stripes, according to the thickness of the sheets to be center-folded, without losing the ease of center-folding.

Specifically, first, when the entrance sensor 207 senses that a sheet is conveyed from the image forming apparatus 101 (YES to step S201), the CPU 201 determines whether or not the conveyed sheet is a sheet to be provided with a folding stripe (step S202).

Here, in the present embodiment, the CPU 201 determines whether or not (YES/NO) the conveyed sheet is a sheet to be provided with the folding stripe based on a table stored in advance shown in FIG. 9.

In the stored table, the number of sheets to be provided with the folding stripes without losing the ease of center-folding and a sheet to be provided with the folding stripe is determined from among the plurality of sheets to be center-folded, according to the thickness of the sheets to be center-folded and according to the limit value of the number of sheets on which the sheet processing apparatus 100 can perform the saddle stitch bookbinding process at a time.

For example, in a case where the limit value of the number of sheets on which the sheet processing apparatus 100 can perform the saddle stitch bookbinding process at a time is 20, according to the table shown in FIG. 9, it is indicated that a folding stripe is formed on each of a sheet to be a cover sheet at the bookbinding and every fourth sheet from the cover sheet, that is, five sheets in total, in a case of sheets each of which has the grammage W which is equal to or smaller than 80 gsm. Therefore, according to the table shown in FIG. 9, the folding stripe is not formed on all of the sheets, that is, the number of sheets provided with the folding stripes is limited according to the thickness of the sheets.

Further, according to the table shown in FIG. 9, the number of sheets provided with the folding stripes increases, with an increase in a thickness of the plurality of sheets to be folded, i.e., with an increase in the grammage W of the plurality of sheets. For example, while the folding stripes are formed on five of the twenty sheets to be center-folded in a case of sheets each of which has the grammage W which is equal to or smaller than 80 gsm, the folding stripes are formed on ten of the twenty sheets to be center-folded in a case of sheets each of which has the grammage W which is greater than 150 gsm.

Next, as a result of the determination of step S202, when the conveyed sheet is not the sheet to be provided with the folding stripe, the CPU 201 controls the conveyance motor 208 to convey the sheet to the storage guide 315 without stopping the sheet at the creasing member 401 (step S204).

As a result of the determination of step S202, when the conveyed sheet is the sheet to be provided with the folding stripe, the CPU 201 controls the conveyance motor 208 to stop the sheet at the creasing member 401 to execute the creasing process of FIG. 5, and the creasing member 401 forms the folding stripe on the sheet (step S203). Subsequently, the CPU 201 controls the conveyance motor 208 to convey the sheet provided with the folding stripe to the storage guide 315 (step S204).

Next, the CPU 201 determines whether or not all of the plurality of sheets to be center-folded are conveyed to the storage guide 315 (step S205). When the CPU 201 determines that all of the sheets are conveyed to the storage guide 315 (YES to step S205), the CPU 201 causes the stapler 316 to perform the stapling process on the sheet bundle stored in the storage guide 315 (step S206).

Next, the CPU 201 drives the pushing member 318 to execute the center-folding process for the sheet bundle (step S207), by this means, the sheet bundle is subjected to the bookbinding. Subsequently, the CPU 201 controls the conveyance motor 208 to eject the sheet bundle subjected to the bookbinding to the tray 321 (step S208), followed by the process terminating.

According to the process of FIG. 8, the folding stripe is not formed on all of the sheets. That is, the sheets to be provided with the folding stripes are determined according to the thickness of the sheets based on the table shown in FIG. 9, and the folding stripes are formed on the determined sheets. Here, if the folding stripes are formed on all of the sheets to be center-folded, and the sheets provided with the folding stripes are folded at a time, and overlaid, the thickness of the fold part of the sheet bundle becomes large due to variation in the positions of the folding stripes on the sheets.

However, in the process of FIG. 8, the number of sheets provided with the folding stripes is limited according to the thickness of the sheets, which makes it possible to reduce the increase in the thickness at the fold part of the sheet bundle. Therefore, the reduction in the quality of the finish of the fold part of the stack of center-folded sheets can be suppressed. Furthermore, in the determination of the sheets to be provided with the folding stripes, the number of sheets to be provided with the folding stripes is limited without losing the ease of center-folding (for example, the number of the sheets to be provided with the folding stripes is limited to one sheet in each set of four sheets in the case of sheets each of which has the grammage W which is equal to or smaller than 80 gsm, as shown in the table of FIG. 9). In this way, it is possible to prevent a loss of the ease of center-folding.

According to the process of FIG. 8 mentioned above, for example, the number of sheets provided with the folding stripes increases, with an increase in the grammage of the plurality of sheets to be folded. As a result, the saddle stitch bookbinding can be easily performed even if the sheets are thick papers that are hard to be folded, without the quality of the finish of the saddle stitch bookbinding being reduced.

According to the process of FIG. 8 mentioned above, the folding stripe is formed on every predetermined number of sheets according to the table shown in FIG. 9 (for example, as shown in the table of FIG. 9, the folding stripe is formed on every fourth sheet, five sheets in total, in the case of sheets each of which has the grammage W which is equal to or smaller than grammage 80 gsm). Therefore, even if there is variation in the positions of the folding stripes in the sheets, the sheets provided with the folding stripes are not overlaid on each other, accordingly, no gap is caused between the overlaid sheets. As a result, it is possible to suppress the reduction in the quality of the finish of the fold part of a stack of center-folding.

Further, according to the process of FIG. 8 mentioned above, the folding stripe is always formed on the sheet to be the cover sheet as shown in the table of FIG. 9. Therefore, the load on the sheet caused by center-folding can be reduced when the sheet to be the cover sheet is center-folded, which makes it possible to prevent peeling of the toner image of the cover sheet.

Figure 10:
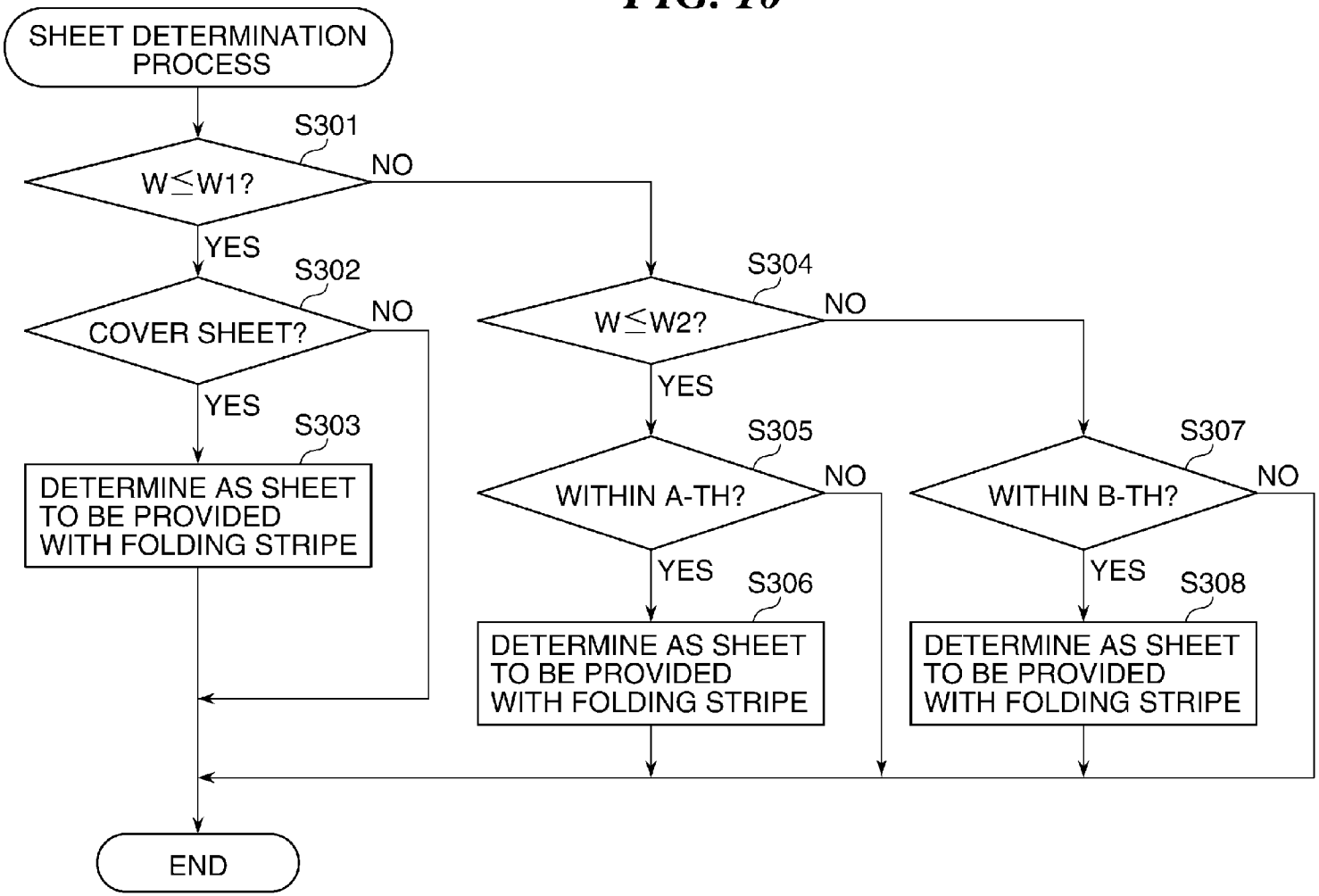
FIG. 10 is a flow chart showing a procedure of a first example of the sheet determination process in the saddle stitch bookbinding process of FIG. 8.

It should be noted that in the present embodiment, the folding stripes may be continuously formed on a predetermined number of sheets from the sheet to be the cover sheet, as shown in FIG. 10 described later.

Figure 11:
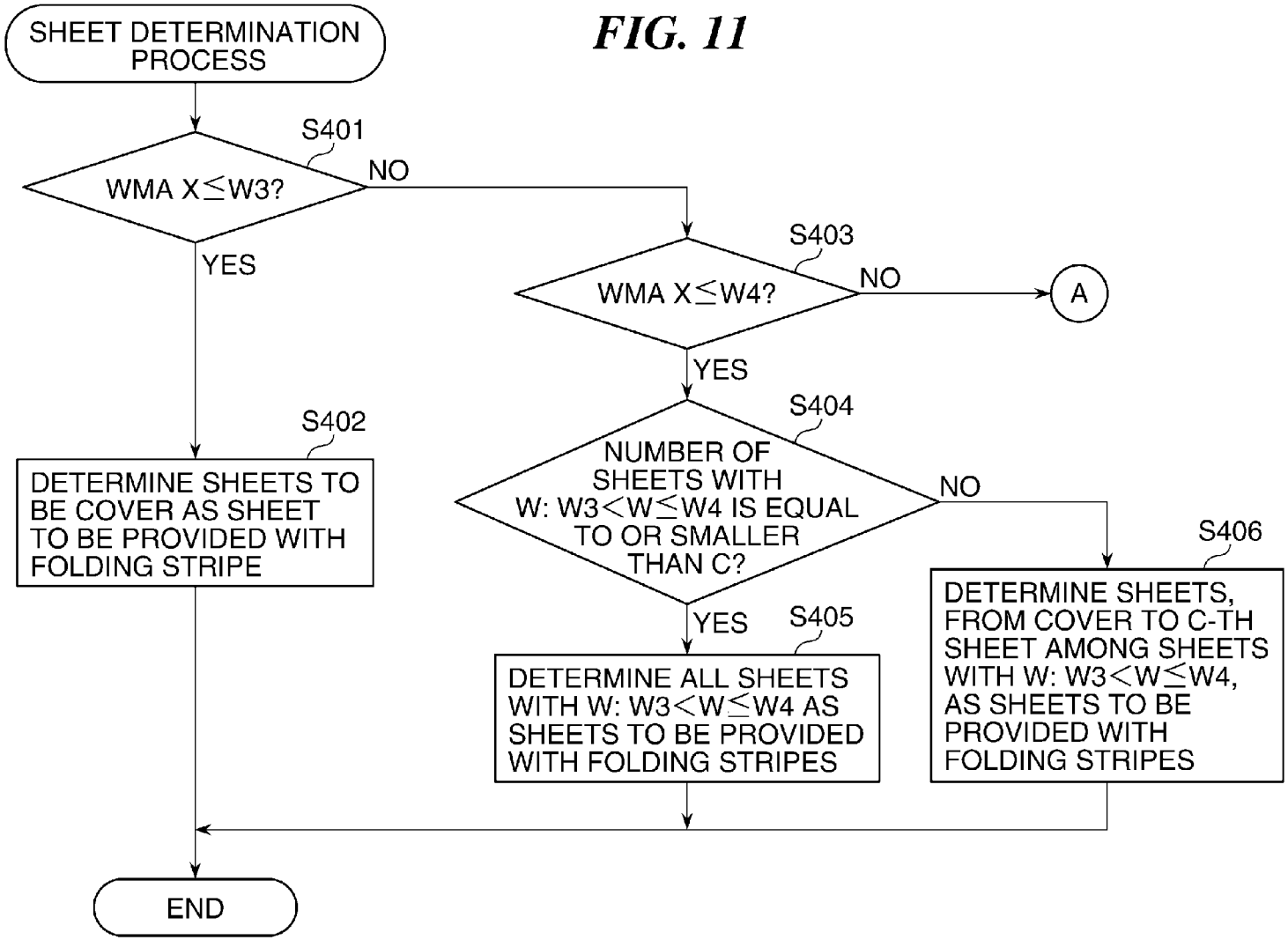
FIG. 11 is a flow chart showing a procedure of a second example of the sheet determination process in the saddle stitch bookbinding process of FIG. 8.
Figure 12:
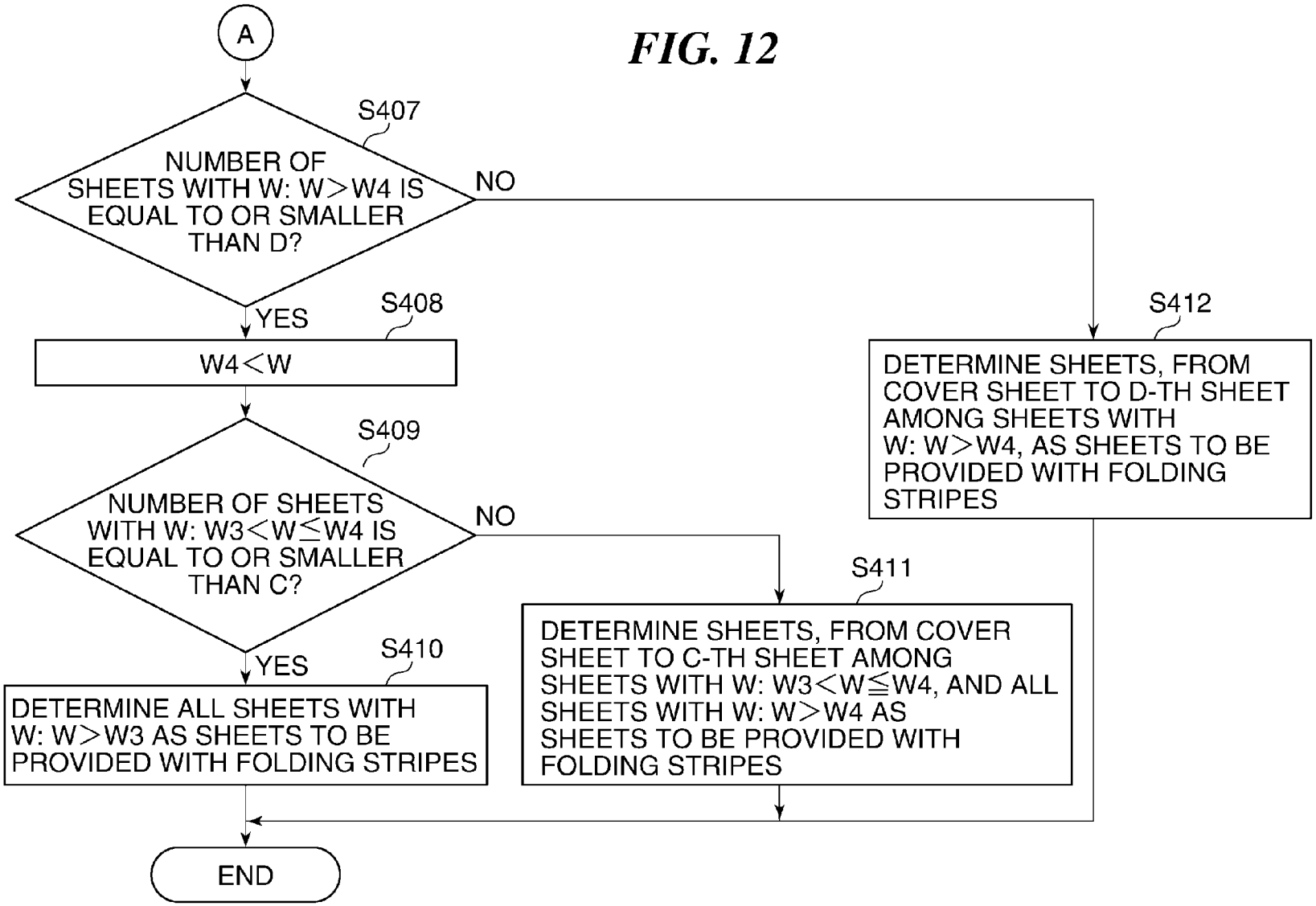
FIG. 12 is the flow chart showing a procedure of the second example of the sheet determination process in the saddle stitch bookbinding process of FIG. 8.

Further, in the sheet determination process (step S202 in FIG. 8), the sheets to be provided with the folding stripes may be determined based on a reference value that is set according to the thickness of the sheets, as shown in FIGS. 10, 11, and 12 described later.

FIG. 10 is a flow chart showing a procedure of a first example of the sheet determination process in the saddle stitch bookbinding process of FIG. 8.

In the process of FIG. 10, CPU 201 determines whether or not the conveyed sheet is a sheet to be provided with the folding stripe based on a reference value that is set without using the table as shown in FIG. 9, at the sheet determination process of step S202 of FIG. 8. Also in the process of FIG. 10, all of the plurality of sheets to be center-folded have the same thickness.

Specifically, first, the CPU 201 determines whether or not the grammage of the sheet W is equal to or smaller than a first grammage W1 (step S301). The first grammage W1 is a thickness determined in advance so as to prevent a loss of the ease of center-folding. In the present example, the first grammage W1 is 80 gsm.

As a result of the determination of step S301, when the grammage of each of the plurality of sheets to be folded W is equal to or smaller than the first grammage W1 ($W \leq W1$), the CPU 201 determines whether or not the conveyed sheet is a sheet to be the cover sheet (step S302).

As a result of the determination of step S302, when the conveyed sheet is the sheet to be the cover sheet, the CPU 201 determines the conveyed sheet as a sheet to be provided with the folding stripe (step S303), followed by the process terminating.

As a result of the determination of step S301, when the grammage of the sheet W is not equal to or smaller than the first grammage W1 ($W > W1$), the CPU 201 determines whether or not the grammage of each of the plurality of sheets to be folded W is equal to or smaller than a second grammage W2 (step S304). The second grammage W2 is greater than the first grammage W1, and is a thickness determined in advance so as to prevent a loss of the ease of center-folding. In the present example, the second grammage W2 is 150 gsm.

As a result of the determination of step S304, when the grammage of the sheets W is equal to or smaller than the second thickness W2 ($W \leq W2$), the CPU 201 determines whether or not the conveyed sheet is within A-th (A: natural number) from the sheet to be the cover sheet (step S305). In the present example, A is set to a value acquired by rounding off $M \times 0.3$, where M is the number of all sheets to be center-folded.

As a result of the determination of step S305, when the conveyed sheet is within A-th from the sheet to be the cover sheet, the CPU 201 determines the conveyed sheet as a sheet to be provided with the folding stripe (step S306), followed by the process terminating.

Although the sheet to be the cover sheet is arranged at a position farthest from the pushing member 318 in the sheet bundle, the folding stripe is continuously formed on the each of the sheets from the sheet to be the cover sheet to the A-th sheet, in the present modified example. Therefore, the folding stripes can be formed on the sheet to be the cover sheet and a plurality of sheets near the sheet to be cover sheet, which are hard to be center-folded due to the difficulty in transmitting force because the sheet is far from the pushing member 318. Accordingly, it is possible to prevent a loss of the ease of center-folding.

As a result of the determination of step S304, when the grammage of the sheets W is not equal to or smaller than the second grammage W2 (W>W2), the CPU 201 determines whether or not the conveyed sheet is within B-th (B: natural number) from the sheet to be the cover sheet (step S307). In the present example, B is greater than A, and B is set to, for example, a value acquired by rounding off M×0.5, where M is the number of all sheets to be center-folded.

As a result of the determination of step S307, when the conveyed sheet is within B-th from the sheet to be the cover sheet, the CPU 201 determines the conveyed sheet as a sheet to be provided with the folding stripe (step S308), followed by the process terminating.

As a result of the determination of step S302, when the conveyed sheet is not the sheet to be the cover sheet; as a result of the determination of step S305, when the conveyed sheet is not within A-th from the sheet to be the cover sheet; or as a result of the determination of step S307, when the conveyed sheet is not within B-th from the sheet to be the cover sheet, the CPU 201 terminates the process.

According to the process of FIG. 10 mentioned above, the CPU 201 determines whether or not the conveyed sheet is a sheet to be provided with the folding stripe based on the set reference value. As a result, the table as shown in FIG. 9 does not have to be used, which makes it possible to determine the sheets to be provided with the folding stripes easily.

FIGS. 11 and 12 are flow chart showing a procedure of a second example of the sheet determination process in the saddle stitch bookbinding process of FIG. 8.

When the plurality of sheets to be center-folded include two or more different kinds of sheets which are different in grammage, it may be difficult to determine the sheets to be provided with the folding stripes according to the grammage of the sheets by the processes of FIGS. 8 and 10 mentioned above. In the processes of FIGS. 11 and 12, the sheets to be provided with the folding stripes are determined according to a grammage WMAX of the sheet with the largest grammage when the sheet bundle to be center-folded include two or more kinds of different sheets which are different in grammage.

Specifically, first, the CPU 201 determines whether or not the grammage WMAX of the sheet with the largest grammage among the plurality of sheets included in the sheet bundle to be center-folded is equal to or smaller than a third grammage W3 (step S401). The third grammage W3 is a thickness determined in advance so as to prevent a loss of the ease of center-folding. In the present example, the third grammage W3 is 80 gsm.

As a result of the determination of step S401, when WMAX is equal to or smaller than W3 (WMAX≤W3), the CPU 201 determines only the sheet to be the cover sheet as the sheet to be provided with the folding stripe (step S402), followed by the process terminating.

As a result of the determination of step S401, when WMAX is not equal to or smaller than W3 (WMAX>W3), the CPU 201 determines whether or not WMAX is equal to or smaller than a fourth grammage W4 (step S403). The fourth grammage W4 is greater than the third grammage W3, and is a thickness determined in advance so as to prevent a loss of the ease of center-folding. In the present example, the fourth grammage W4 is 150 gsm.

As a result of the determination of step S403, when WMAX is equal to or smaller than W4 (WMAX≤W4), the CPU 201 determines whether or not the number of sheets with the grammage W greater than W3 and equal to or smaller than W4 (W3<W≤W4) is equal to or smaller than C (C: natural number) (step S404). In the present example, C is set to, for example, a value acquired by rounding off M×0.3, where M is the number of all sheets to be center-folded.

As a result of the determination of step S404, when the number of sheets with the grammage W greater than W3 and equal to or smaller than W4 (W3<W≤W4) is equal to or smaller than C, the CPU 201 determines the all of the sheets with the grammage W greater than W3 and equal to or smaller than W4 (W3<W≤W4) as sheets to be provided with the folding stripes (step S405), followed by the process terminating.

As a result of the determination of step S404, when the number of sheets with the grammage W greater than W3 and equal to or smaller than W4 (W3<W≤W4) is not equal to or smaller than C, the CPU 201 determines the sheets, from the sheet to be the cover sheet to the C-th sheet, as the sheets to be provided with the folding stripes among the sheets with the thickness greater than W3 and equal to or smaller than W4 (W3<W≤W4) (step S406), followed by the process terminating. In the present example, for example, the CPU 201 determines the sheets from the sheet to be the cover sheet to the (M×0.3)-th sheet as the sheets to be provided with the folding stripes, among the sheets with the grammage W greater than 80 gsm and equal to or smaller than 150 gsm (80 gsm<W≤150 gsm), where M is the number of the all sheets to be center-folded.

As a result of the determination of step S403, when WMAX is not equal to or smaller than W4 (WMAX>W4), the CPU 201 determines whether or not the number of sheets with the grammage W greater than W4 is equal to or smaller than D (D: natural number) (step S407). In the present example, D is set to, for example, a value acquired by rounding off M×0.5, where M is the number of all sheets to be center-folded.

As a result of the determination of step S407, when the number of sheets with the grammage W greater than W4 (W>W4) is equal to or smaller than D, the CPU 201 determines whether or not the number of sheets with the grammage W greater than W3 and equal to or smaller than W4 (W3<W≤W4) is equal to or smaller than C (step S409).

As a result of the determination of step S409, when the number of sheets with the grammage W greater than W3 and equal to or smaller than W4 (W3<W≤W4) is equal to or smaller than C, the CPU 201 determines the all of the sheets with the grammage W greater than W3 (W>W3) as the sheets to be provided with the folding stripes (step S410), followed by the process terminating.

As a result of the determination of step S409, when the number of sheets with the grammage W greater than W3 and equal to or smaller than W4 (W3<W≤W4) is not equal to or smaller than C, the CPU 201 determines the sheets from the sheet to be the cover sheet to the C-th sheet among the sheets with the grammage W greater than W3 and equal to or smaller than W4 (W3<W≤W4) and all of the sheets with the grammage W greater than W4 (W>W4), as the sheets to be provided with the folding stripes, (step S411), followed by the process terminating.

As a result of the determination of step S407, when the number of sheets with the grammage W greater than W4 (W>W4) is not equal to or smaller than D, the CPU 201 determines the sheets from the sheet to be the cover sheet to the D-th sheet among the sheets with the grammage W greater than W4 (W>W4), as the sheets to be provided with the folding stripes (step S412), followed by the process terminating.

According to the processes of FIGS. 11 and 12 mentioned above, the sheets to be provided with the folding stripes are determined according to the thickness of the sheet with the largest thickness among the plurality of sheets with different thicknesses, which makes it possible, for example, to prevent a loss of the ease of center-folding by increasing the number of sheets to be provided with the folding stripes, when the thickness of the sheet with the largest thickness is equal to or greater than a predetermined thickness.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-153768, filed Jul. 29, 2014 is hereby incorporated by reference herein in its entirety.

What is claimed is:

1. A sheet processing apparatus comprising:

a creaser configured to form a folding stripe on a sheet so as to facilitate folding of the sheet;

a receiver configured to receive information related to thickness of the sheet; and a controller configured to:

determine, for a sheet representing a cover sheet among a plurality of sheets to be folded and overlaid, to form a folding stripe thereon by the creaser, regardless of the information related to the thickness of the sheet received by the receiver, and determine, for each sheet among the plurality of sheets other than the sheet representing the cover sheet, whether or not to form a folding stripe thereon, according to the information related to the thickness of the sheet received by the receiver.

2. The sheet processing apparatus according to claim 1, wherein the controller controls the creaser to form the folding stripe on every predetermined number of sheets determined according to the information related to the thickness of the sheets received by the receiver.

3. The sheet processing apparatus according to claim 1, wherein the controller controls the creaser to continuously form the folding stripe on each of a predetermined number of sheets from the sheet representing the cover sheet at a time when the plurality of sheets are folded with overlaid.

4. The sheet processing apparatus according to claim 1, further comprising a folding machine configured to fold the overlaid plurality of sheets.

5. A sheet processing apparatus comprising:

a creaser configured to form a folding stripe on a sheet so as to facilitate folding of the sheet;

a receiver configured to receive information related to thickness of the sheet; and a controller configured to determine one or more sheets, among a plurality of sheets to be folded and overlaid, to be provided with folding stripes by the creaser, according to the information related to the thickness of the sheets received by the receiver, and to control the creaser so as to form the folding stripe on each of the determined one or more sheets, wherein the controller determines, when the thickness of the sheets is a second thickness greater than a first thickness, the sheets to be provided with the folding stripes so that the number of sheets to be provided with the folding stripes is greater than the number of sheets determined when the thickness of the sheets is the first thickness.

6. The sheet processing apparatus according to claim 5, wherein the controller controls the creaser so as to form the folding stripe at least on a sheet representing the cover sheet at a time when the plurality of sheets are folded and overlaid.

7. The sheet processing apparatus according to claim 5, wherein the controller controls the creaser to form the folding stripe on every predetermined number of sheets determined according to the information related to the thickness of the sheets received by the receiver.

8. The sheet processing apparatus according to claim 5, wherein the controller controls the creaser to continuously form the folding stripe on each of a predetermined number of sheets from the sheet representing a cover sheet at a time when the plurality of sheets are folded and overlaid.

9. The sheet processing apparatus according to claim 5, further comprising a folding machine configured to fold the overlaid plurality of sheets.

10. A sheet processing apparatus comprising:

a creaser configured to form a folding stripe on a sheet so as to facilitate folding of the sheet;

a receiver configured to receive information related to thickness of the sheet; and a controller configured to determine one or more sheets, among a plurality of sheets to be folded and overlaid, to be provided with folding stripes by the creaser, according to the information related to the thickness of the sheets received by the receiver, and to control the creaser so as to form the folding stripe on each of the determined one or more sheets, wherein the plurality of sheets include sheets with different thicknesses, and the controller determines the sheets to be provided with the folding stripes according to the thickness of the sheet having the largest thickness among the plurality of sheets.

11. The sheet processing apparatus according to claim 10, further comprising a folding machine configured to fold the overlaid plurality of sheets.

12. A sheet processing apparatus comprising:

a creaser configured to form a folding stripe on a sheet so as to facilitate folding of the sheet;

a receiver configured to receive information related to thickness of the sheet; and a controller configured to determine one or more sheets, among a plurality of sheets to be folded and overlaid, to be provided with folding stripes by the creaser, according to the information related to the thickness of the sheets received by the receiver, and to control the creaser so as to form the folding stripe on each of the determined one or more sheets, wherein the plurality of sheets include sheets different in information related to thickness of sheet, and the controller determines, from among the plurality of sheets, the one or more sheets to be provided with the folding stripes, according to the specific number of sheets, of which the information related to thickness is within a predetermined range.

13. The sheet processing apparatus according to claim 12, wherein the controller determines all of the specific sheets as the sheets to be provided with the folding stripes when the number of the specific sheets is within the predetermined range, and determines a predetermined number of sheets from a sheet representing the cover sheet at a time when the plurality of sheets are folded and overlaid as the sheets to be provided with the folding stripes when the number of the specific sheets are not within the predetermined range.

14. The sheet processing apparatus according to claim 12, further comprising a folding machine configured to fold the overlaid plurality of sheets.

15. An image forming apparatus comprising:

an image forming unit configured to form an image on a sheet;

a creaser configured to form a folding stripe on the sheet, which has the image formed thereon by the image forming unit, so as to facilitate folding of the sheet;

a determinator configured to determine information related to thickness of the sheet; and a controller configured to:

determine, for a sheet representing a cover sheet among a plurality of sheets to be folded and overlaid, to form a folding stripe thereon by the creaser, regardless of the information related to the thickness of the sheet determined by the determinator, and determine, for each sheet among the plurality of sheets other than the sheet representing the cover sheet, whether or not to form a folding stripe thereon, according to the information related to the thickness of the sheet determined by the determinator.

16. A control method for controlling a sheet processing apparatus comprising a creaser configured to form a folding stripe on a sheet so as to facilitate folding of the sheet, the control method comprising:

receiving information related to thickness of the sheet;

determining, for a sheet representing a cover sheet among a plurality of sheets to be folded and overlaid, to form a folding stripe thereon by the creaser, regardless of the received information related to the thickness of the sheet, and determining, for each sheet among the plurality of sheets other than the sheet representing the cover sheet, whether or not to form a folding stripe thereon, according to the received information related to the thickness of the sheet.

* * * * *